US005735160A

United States Patent [19]

VanSumeren et al.

[11] Patent Number: 5,735,160

[45] Date of Patent: Apr. 7, 1998

[54] STRETCH FORMING METAL BODIES WITH POLYMERIC INTERNAL MANDRELS

[75] Inventors: Thomas J. VanSumeren, Waterford, Mich.; Robert P. Evert, Allison Park, Pa.

[73] Assignee: Aluminum Company of America, Pittsburgh, Pa.

[21] Appl. No.: 839,616

[22] Filed: Apr. 15, 1997

[51] Int. Cl.[6] ..... B21D 9/01

[52] U.S. Cl. ..... 72/296; 72/57; 72/370; 72/465; 29/421.1

[58] Field of Search ..... 72/296, 297, 54, 72/57, 58, 370, 465; 29/421.1

[56] References Cited

U.S. PATENT DOCUMENTS

| | | | |
|---|---|---|---|
| 2,693,637 | 11/1954 | Peabody | 72/296 |
| 3,209,439 | 10/1965 | Arbogast | 29/421.1 |
| 4,006,619 | 2/1977 | Anderson | 72/58 |
| 4,493,203 | 1/1985 | Wheeler | 72/369 |
| 4,704,886 | 11/1987 | Evert et al. | 72/57 |
| 4,803,878 | 2/1989 | Moroney | 72/296 |
| 4,970,886 | 11/1990 | Sikora et al. | 72/302 |
| 5,214,951 | 6/1993 | Waddell | 72/297 |
| 5,323,631 | 6/1994 | Weykamp et al. | 72/296 |
| 5,327,765 | 7/1994 | Weykamp et al. | 72/296 |
| 5,349,839 | 9/1994 | Weykamp et al. | 72/296 |
| 5,351,517 | 10/1994 | Spath | 72/297 |
| 5,502,997 | 4/1996 | Boettger | 72/296 |
| 5,564,303 | 10/1996 | Buchanan | 72/465 |

*Primary Examiner*—Daniel C. Crane
*Attorney, Agent, or Firm*—Glenn E. Klepac

[57] ABSTRACT

A hollow metal body is shaped by a process including simultaneous stretching and bending. The body is stretched longitudinally by pulling end portions in opposite directions with sufficient force to exceed an elastic limit and to initiate elongation through plastic deformation. While the body is being stretched longitudinally, it is bent between its end portions transversely of the direction of pulling. Solid polymeric first and second mandrels are inserted into end portions of the body to prevent collapse during bending.

10 Claims, 2 Drawing Sheets

STRETCH FORMING METAL BODIES WITH POLYMERIC INTERNAL MANDRELS

CROSS REFERENCE TO RELATED APPLICATIONS

This application claims the benefit of U.S. application Ser. No. 60/036,798, filed Jan. 31, 1997.

FIELD OF THE INVENTION

The invention pertains to a process for shaping an elongated hollow metal body that is preferably an aluminum alloy extrusion. Shaped extrusions made by the process of the invention are used as vehicle body components.

BACKGROUND OF THE INVENTION

Aluminum alloy extrusions have long been used as components of vehicles, including automobiles, trucks, boats and aircraft. Such extrusions are typically made by a process wherein a heated ingot or billet is forced through a die opening under pressure to form an elongated body such as a channel, tube or angle. The extruded product is generally forced through a die at forces in the 500 to 15,000 ton range. The extrusion exits the die at elevated temperatures on the order of 300°–1200° F. The extruded product is then commonly solution heat treated and quenched. The product may be made to various lengths, including lengths in excess of 150 feet, and may have any of a diverse variety of cross-sectional configurations.

In order for the extrusions to be suitable as vehicle body components such as automobile roof rails, they must be shaped into more complex configurations. Some processes employed in the prior art for shaping aluminum alloy extrusions include bending, stretch-forming and stretch-wrap forming. These prior art processes perform adequately in instances where the degree of deformation is small or where dimensional tolerances are large. However, there is still a need for an improved shaping process when large deformations are required and dimensional tolerances are small.

A principal objective of the present invention is to provide a process for stretch-forming hollow metal bodies wherein polymeric mandrels are placed inside the bodies in order to prevent collapse of the bodies when they are bent.

A related objective of the invention is to provide a process for stretch-forming hollow metal bodies wherein the bodies undergo smaller deviations from desired dimensions than in the prior art.

Additional objectives and advantages of the invention will become apparent to persons skilled in the art from the following specification and claims.

SUMMARY OF THE INVENTION

In accordance with the present invention, there is provided a process for forming elongated hollow metal bodies into desired shapes. The hollow metal bodies are preferably aluminum alloy extrusions.

Some preferred aluminum alloys for the extrusions of the invention are aluminum-copper alloys of the AA 2000 series, aluminum-magnesium-silicon alloys of the AA 6000 series and aluminum-zinc alloys of the AA 7000 series. Extrusions preferred for use in the automotive and aircraft industries that may be stretch formed by the present invention include, but are not limited to, the AA 2024, 6013, 6061, 6063, 6009 and 7075 aluminum alloys.

Extrusions that are shaped in accordance with the invention are elongated hollow bodies having opposed, longitudinal by spaced end portions. The extrusions generally start with a substantially uniform cross section from end to end. Total length is generally about 44 to 120 inches (112 to 305 cm).

A solid polymeric first mandrel is mechanically inserted into a first end portion of the body. A solid polymeric second mandrel is mechanically inserted into a second end portion. The two mandrels preferably each extend longitudinally about half of the length of the body.

The polymeric mandrels are preferably made from solid polyurethane. In a particularly preferred embodiment, they each have a durometer hardness of about 90 A or 70 D.

The polymeric mandrels are molded into a desired size and shape by using one of the hollow bodies as a mold. In a particularly preferred embodiment, a hot molten mass of polyurethane is placed inside the body. The polyurethane shrinks as it cools and cures, forming a solid shape that is smaller than the body interior. The solid shape is then removed and cut into first and second mandrels of equal length. A steel shank is fastened to a lateral end of each mandrel.

End portions of an extrusion are gripped by the jaws of opposed grippers and the extrusion is stretched longitudinally by pulling the end portions in opposite directions. Sufficient force is exerted on the grippers to exceed an elastic limit so that elongation through plastic deformation is initiated.

While the extrusion is being stretched longitudinally, it is bent transversely of the direction of pulling. Bending is preferably accomplished by moving the extrusion forcibly against a forming die or shaping die. Sufficient force is exerted to impart a contour to the extrusion similar to the forming die contour.

The polymeric mandrels each have an outer wall adjacent an interior wall of the hollow body. The mandrels support the interior wall during bending so that it does not collapse.

A die adjacent the hollow body bends it transversely of the direction of stretching. Then, the body is stretched again to relieve residual stress introduced by bending. This second stretch minimizes any tendency of the metal to spring back to its original shape because of a memory effect. Finally, the bending is relaxed.

After the second stretching is relaxed, the grippers are released from the end portions and the mandrels are mechanically removed from the hollow body.

DETAILED DESCRIPTION OF PREFERRED EMBODIMENTS

Figure 1:
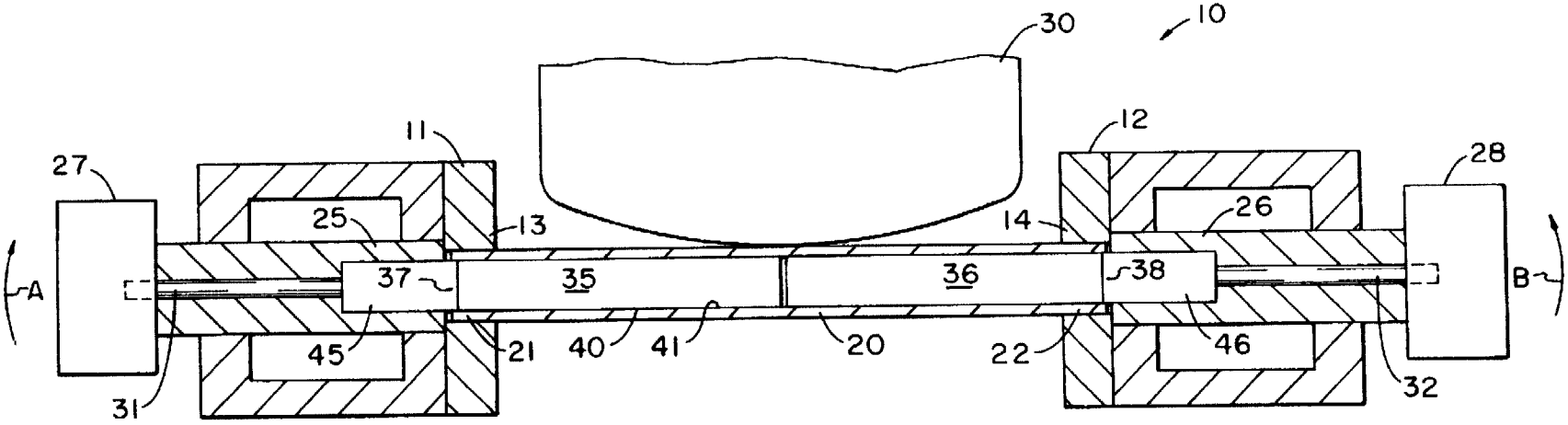
FIG. 1 is a schematic illustration of an apparatus for forming hollow metal bodies in accordance with the present invention.

In the process of the present invention, aluminum alloy extrusions are stretch-formed into shapes that are useful as vehicle body components such as automobile roof rails. A stretch-forming apparatus 10 for carrying out the process of the invention is shown in FIG. 1.

The apparatus 10 includes a pair of opposed grippers or gripper assemblies 11, 12 having jaws 13, 14 for gripping portions of an aluminum alloy extrusion 20. A first jaw 13 grasps a first end portion 21 and a second jaw 14 grasps a second end portion 22 of the extrusion 20. The jaws 13, 14 selectively grip and release the end portions 21, 22 upon command from an operator (not shown) of the apparatus 10.

The gripper assemblies 11, 12 are carried by guides or jackets 25, 26 extending from hydraulic cylinder assemblies 27, 28. The guides 25, 26 support the gripper assemblies 11, 12. The cylinder assemblies 27, 28 are carried by adjustable mountings to permit rotation in the direction of arrows A, B with respect to a forming die or shaping die 30.

The guides 25, 26 contain piston rods 31, 32 extending from the hydraulic cylinder assemblies 27, 28. After an aluminum extrusion 20 is mounted between the gripper assemblies 11, 12, the piston rods 31, 32 push solid polyurethane mandrels 35, 36 through open ends 37, 38 of the extrusion 20. The mandrels 35, 36 each extend about halfway through the extrusion 20. A steel shank 45, 46 attached to each mandrel 35, 36 extends laterally outwardly of the open ends 37, 38. Guides 25, 26 adjacent the shanks 45, 46 stabilize the mandrels 35, 36 inside the extrusion 20 when it is stretched and bent as described below.

The mandrels 35, 36 each have an outer wall 40 adjacent an interior wall 41 of the extrusion 20. Although the mandrels 35, 36 are smaller than the end openings 37, 38 when the mandrels 35, 36 are inserted, a lubricant is applied through a fibrous wick (not shown) adjacent the outer wall 40 through openings in the guides 25, 26. The lubricant facilitates removal of the mandrels 35, 36 after the extrusion 20 is shaped. The openings 37, 38 in the extrusion 20 become smaller after stretching.

When the mandrels 35, 36 are positioned inside the extrusion 20, the jaws 13, 14 are tightened firmly over the end portions 21, 22. Then, the hydraulic cylinder assemblies 27, 28 stretch the extrusion 20 longitudinally by pulling on the guides 25, 26. After stretching is initiated, the gripper assemblies 11, 12 swing as indicated by the arrows A, B to form the extrusion 20 over the forming die 30.

After the extrusion 20 is bent transversely to a desired degree, the extrusion 20 is stretched again by the cylinder assemblies 27, 28 to relieve residual stresses introduced by bending. This second stretch minimizes any tendency of the metal extrusion 20 to spring back to its original shape.

The second stretching is then relaxed, the jaws 13, 14 are released from the end portions 21, 22 and the mandrels 35, 36 are mechanically removed.

Figure 2:
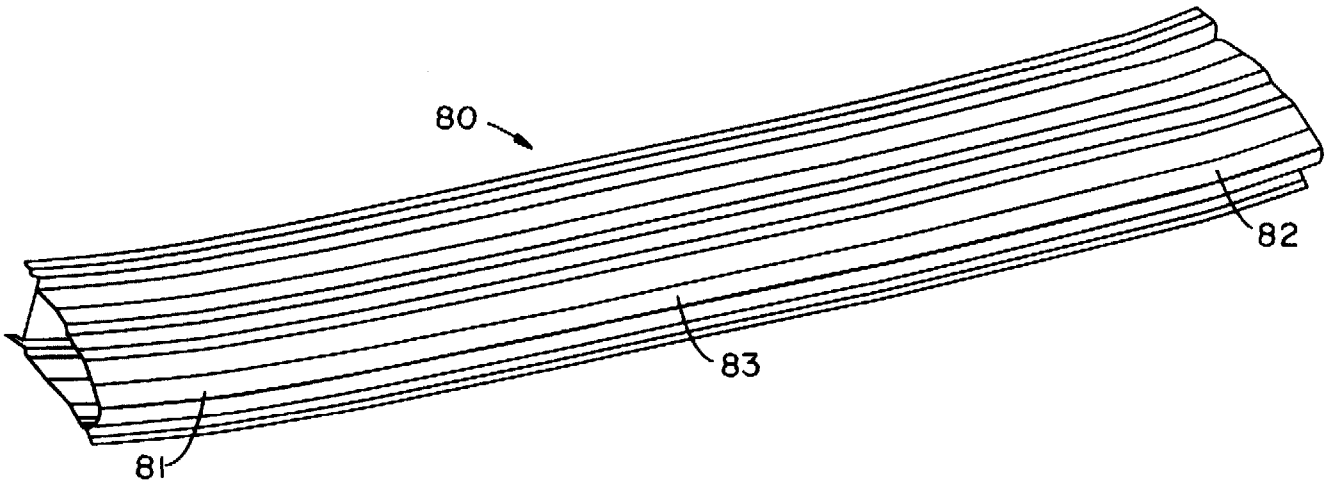
FIG. 2 is a perspective view of an aluminum alloy extrusion that has been formed in accordance with the invention.

A shaped extrusion 80 made in accordance with our invention is shown in FIG. 2. The extrusion 80 has a first end portion 81, a second end portion 82 and a center portion 83. The first end portion 81 has a bend radius of about 7 times the part depth (7 D bend). The second end portion 82 has a bend radius of about 4 times the part depth (4 D bend). The center portion 83 has a bend radius of about 65 times the part depth (65 D bend). Our experience with prior art bending methods is that dimensional tolerance problems are to be expected in the end portions 81, 82 because of their tighter bend radii.

Having described the presently preferred embodiments, it is to be understood that the invention may be otherwise embodied within the scope of the appended claims.

What is claimed is:

1. A process for forming into a desired shape an elongated hollow metal body having opposed longitudinally spaced first and second end portions comprising:

(a) inserting a solid polymeric first mandrel into said first end portion and a solid polymeric second mandrel into said second end portion, each said mandrel having an outer wall adjacent an interior wall of said body;

(b) stretching said body longitudinally by pulling said end portions in opposite directions with sufficient force to exceed an elastic limit and to initiate elongation through plastic deformation; and (c) while stretching said body longitudinally, bending the body between its end portions transversely of the direction of the pulling, each said mandrel supporting said body against collapse during said bending.

2. The process of claim 1 further comprising:

(d) again stretching said body longitudinally, thereby to relieve residual stress caused by said bending.

3. The process of claim 2 further comprising:

(e) gripping said end portions with grippers during steps (b), (c) and (d).

4. The process of claim 3 further comprising:

(f) relaxing said stretching, releasing said grippers from said end portions and removing each said mandrel.

5. The process of claim 1 wherein each said mandrel comprises polyurethane.

6. The process of claim 1 wherein said first mandrel and said second mandrel each extend longitudinally about halfway through said metal body.

7. The process of claim 1 wherein said metal body comprises an aluminum alloy extrusion.

8. The process of claim 1 wherein said extrusion comprises an alloy of the AA 2000, 6000 or 7000 series.

9. The process of claim 1 wherein a steel shank is attached to each said mandrel and a guide adjacent each said shank stabilizes each said mandrel inside the hollow body during steps (b) and (c).

10. A process for shaping an elongated aluminum alloy extrusion having opposed, longitudinally spaced first and second end portions comprising:

(a) inserting a solid polymeric first mandrel into said first end portion and a solid polymeric second mandrel into said second end portion, each said mandrel having an outer wall adjacent an interior wall of said extrusion;

(b) stretching said extrusion longitudinally by pulling said end portions in opposite directions with sufficient force to exceed an elastic limit and to initiate elongation through plastic deformation;

(c) while stretching said extrusion longitudinally, bending the extrusion between its end portions transversely of the direction of the pulling, each said mandrel supporting said extrusion against collapse during said bending; and (d) again stretching said extrusion longitudinally, thereby to relieve residual stress caused by said bending.

* * * * *